United States Patent [19]

Schieck et al.

[11] Patent Number: 4,994,864

[45] Date of Patent: Feb. 19, 1991

[54] COPY SHEET SKEW ADJUSTMENT DEVICE

[75] Inventors: Richard A. Schieck; Don S. Walker; Vincent S. Carrozzi, all of Rochester; H. William Gray, Lima, all of N.Y.

[73] Assignee: Xerox Corporation, Stamford, Conn.

[21] Appl. No.: 447,322

[22] Filed: Dec. 7, 1989

[51] Int. Cl.[5] ..... G03G 15/00

[52] U.S. Cl. ..... 355/317; 271/184; 355/271

[58] Field of Search ..... 355/317, 309, 271; 198/416, 434; 271/184, 188, 306

[56] References Cited

U.S. PATENT DOCUMENTS

| | | | |
|---|---|---|---|
| 4,146,220 | 3/1979 | Barton | 271/233 |
| 4,410,264 | 10/1983 | Holzhauser et al. | 355/317 |
| 4,428,666 | 1/1984 | Phelps et al. | 355/317 |
| 4,436,403 | 3/1984 | Rhodes, Jr. et al. | 355/317 X |
| 4,464,042 | 8/1984 | Ormori et al. | 355/271 |
| 4,487,407 | 12/1984 | Baldwin | 355/317 X |
| 4,823,159 | 4/1989 | Yamamoto et al. | 355/3 |

*Primary Examiner*—R. L. Moses

[57] ABSTRACT

A printing apparatus includes a copy sheet skew adjustment device. The copy sheet adjustment device is a pivotable baffle positioned between transfer and copy sheet registration stations of the printer and hinged at one end. At the other end, the baffle is connected to a screw and a nut such that when the nut is rotated it pivots the baffle further either into or out of the path of the copy sheets. This shortens or lengthens the distance the copy sheets have to travel to the transfer station and in doing so skews the copy sheets to the proper alignment.

13 Claims, 2 Drawing Sheets

COPY SHEET SKEW ADJUSTMENT DEVICE

This invention relates to an electrophotographic printing machine, and more particularly, concerns an improved device for adjusting copy sheet skew in such a machine.

In most copiers, duplicators and printers, copy sheets are delivered to a transfer station where images are applied to the copy sheets. Since alignment of each image on the copy sheets (skew) is usually critical, it must be controlled or adjusted out. It is usually difficult to relate either the paper or the image, since each is typically transported by massive hardware. In addition, when copy sheets are transported around a sharp bend just prior to transfer, rotation of the controlling hardware becomes even more difficult due to geometric and space constraints.

One of the existing and standard methods for deskewing and side registering substrates in a copier or printer includes the use of ball-on-belt system, scuffer wheels, crossed rolls and ball-on-roll systems. A ball-on-belt system is used with, for example, a lead edge timing scheme and allows the lead edge of a substrate, driven by the belt, to be timed into a set of take away rolls so that the substrate reaches the transfer station in synchronism with a particular image on the photoreceptor. Some of the problems associated with this type of lead edge and side registration system encompasses mechanical drives for deskewing and shift registration and take away pinch roll devices. In addition, damage to copy substrates including jamming is possible due to crumpling, or counter clockwise rotation about the lead registration guide, corner of the substrates. This is due to the adverse couple created between side registration mechanisms and the resisting frictional force between the substrate and the registration guide. These devices are designed to control skew variability. Obviously, a simple low cost device that can deskew copy sheets without damage while controlling the average skew in copy sheets would be quite useful since less course adjustments for skew variability by the standard deskewing methods would be required.

Accordingly, in accordance with the present invention, a copy sheet skew adjustment device is disclosed that includes a movable or pivoting baffle positioned in the path of copy sheets such that pivoting of the enclosed end of the baffle shortens the copy sheet travel distance between registration rolls and the transfer area, and thereby deskewing the copy sheets.

For a better understanding of the invention as well as other features thereof, reference is made to the following drawings and descriptions.

While the present invention will be described herein after in a connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
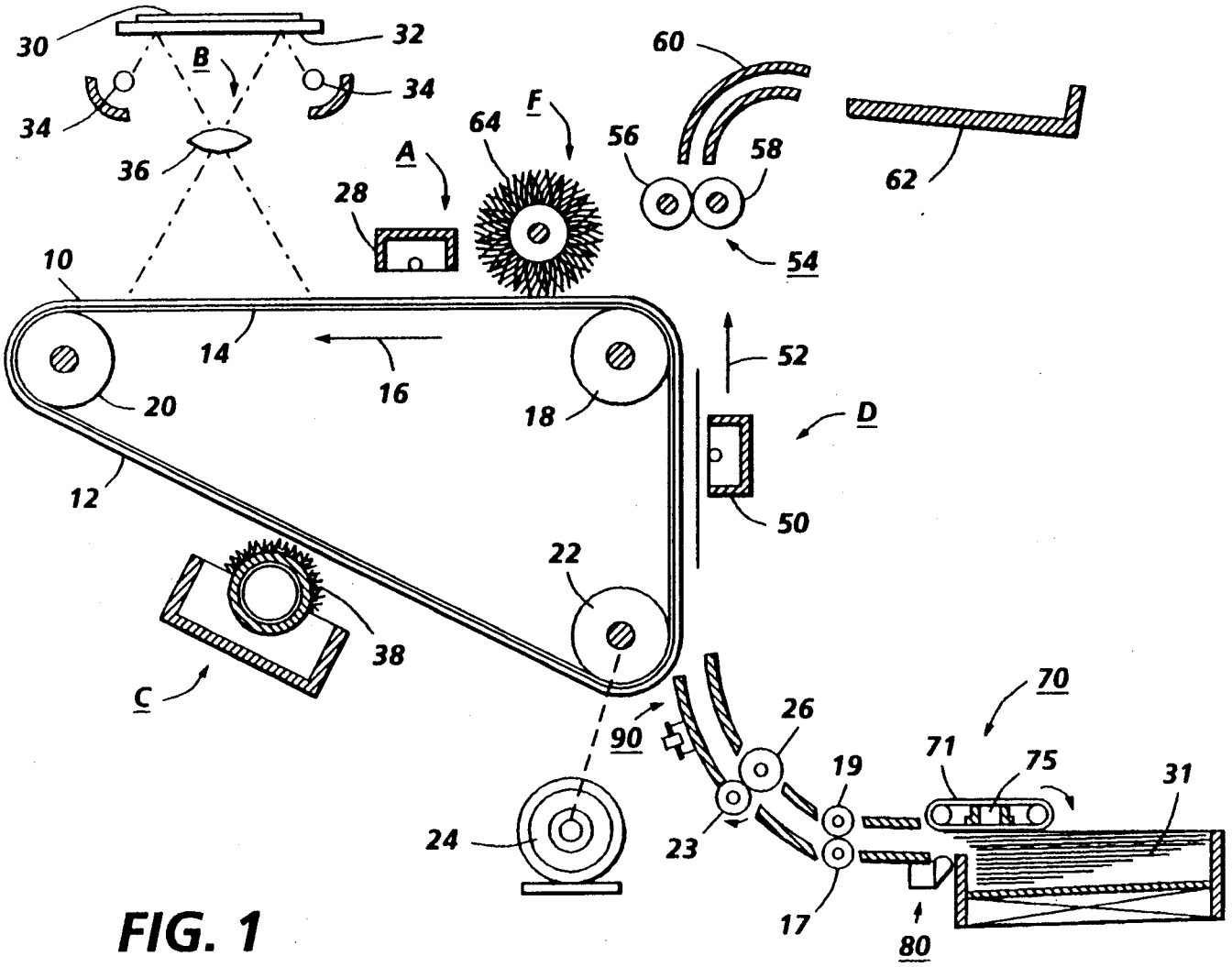
FIG. 1 is a schematic elevational view of an electrophotographic printing machine incorporating the features of the present invention.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the skew adjustment method and apparatus of the present invention therein. It will become evident from the following discussion that the copy sheet skew adjustment system disclosed herein is equally well suited for use in a wide variety of devices and is not necessarily limited to its application to the particular embodiment shown herein. For example, the apparatus of the present invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electophotographic printing machine employs a belt 10 having a photoconductive surface 12 deposited on a conductive substrate 14. Preferably, photoconductive surface 12 is made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatably. These rollers are idlers which rotate freely as belt 10 moves int h direction of arrow 16.

With continued reference to FIG. 1, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface 12 to selectively dissipate the charge thereon. This records an electrostatic latent image on photoconductive surface 12 which corresponds to the information area contained within original document 30.

Thereafter, belt 10 advances the electrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on photoconductive surface 12 of belt 10.

Belt 10 then advances the toner powder image to transfer station D. At transfer station D, a sheet of support material is moved into contact with the toner powder image. The sheet of support material is advanced toward transfer station D by top vacuum corrugation feeder 70. Preferably, the feeder includes an air knife 80 which floats a sheet 31 up to where it is grabbed by the suction force from vacuum plenum 75. A perforated feed belt 71 then forwards the now separated sheet for further processing, i.e., the sheet is directed through rollers 17, 19, 23, and 26 into contact with the photoconductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal form the printing machine by the operator.

Invariably, after the sheet of support material is separated form the photoconductive surface 12 of belt 10 some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient to illustrate the general operation of an electrostatographic machine.

Figure 2:
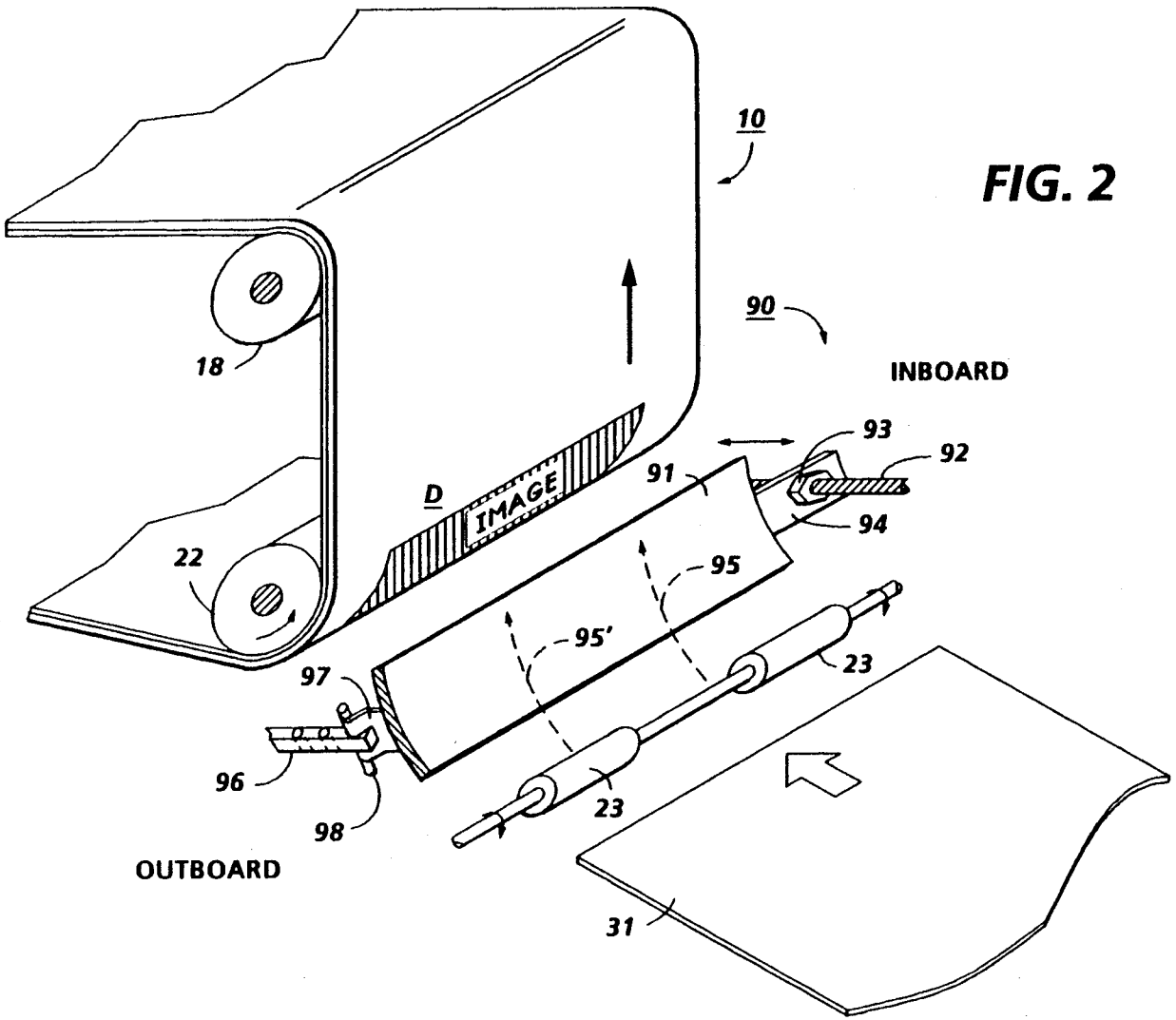
FIG. 2 is an enlarged partial cross-sectional view of the exemplary skew adjustment device in accordance with the present invention.

Referring now to a particular aspect of the present invention, FIG. 2 shows a system employing the present invention in a copy sheet feeding mode. A copy sheet skew adjustment device 90 is disclosed that comprises a pivoting transport baffle 91 that is positioned between registration rolls 23 and the transfer area D for adjusting skew or alignment of copy sheet 31 with the images on belt 10. Baffle 91 is hinged for pivotal movement about pin 98 between movable extension member 97 and fixedly secured support member 96 at the outboard end of the transport. At the inboard end of the transport baffle 91, a flange portion 94 is captured by an adjustable stop that includes screw 92 and nut 93 with the stop being on the inboard side frame of the printer. When the stop is advanced upward, the outboard end of the baffle 91 protrudes further into the copy sheet path, effectively shortening the distance indicated by dotted arrow 95 that the copy sheet 31 must travel from registration rolls 23 to transfer area D, however, this particular shortening of copy sheet travel distance affects only the inboard side of the baffle. Since the distance shown by dotted arrow 95', that copy sheet 31 must travel on the outboard side is unchanged, the lead edge of the copy sheet is effectively rotated relative to the transferring image. Adjustment range of baffle 91 may be increased by relocating pin 98 into different locations shown in dotted lines in FIG. 2 which allow the outboard end of baffle 91 to protrude further into or out of the copy sheet path.

Normally, this adjustment of skew of copy sheets is made at the manufacturing facility, however, it can also be made by technical representatives in the field at the time of machine installation. In either case, one would run copies of page image information, observe the page image information for misalignment and if there is any misalignment of the images on a copy sheet, screw 93 is rotated to adjust alignment baffle 91 to either protrude further into the copy sheet path or further out of the copy sheet path thereby skewing the sheet and correcting misalignment.

While there has been illustrated and described what is at present considered to be a preferred embodiment of the present invention, it will be appreciated that numerous changes and modifications are likely to occur to those skilled in the art, and it is intended int eh appended claims to cover all those changes and modifications which fall within the true spirit and scope of the present invention.

We claim:

1. In a printing apparatus having an image transfer area and copy sheet registration rolls for driving copy sheets into the transfer area where images are transferred to the copy sheets, the improvement characterized by a copy sheet skew adjustment device for insuring alignment of images transferred to the copy sheets, comprising:

pivotable baffle means positioned to contact the image side of copy sheets between the transfer area and the registration rolls; and means for pivoting said pivotable baffle means in a predetermined direction in order to shorten a portion of the distance the copy sheets have to travel between the transfer area and the registration rolls and thereby adjust skew of the copy sheets.

2. The printing apparatus of claim 1, wherein said pivotable baffle is hinged on one end thereof.

3. The printing apparatus of claim 2, wherein said means for pivoting said pivotable baffle means is a screw and nut mechanism.

4. A device for correcting image to copy skew of substrates traveling between registration and transfer stations in a copier/printer, comprising:

adjustable baffle means through which the substrates travel en route from said registration station to said transfer station; and adjustment means for pivoting said adjustable baffle into and out of the path of the substrates in order to shorten the distance the substrates have to travel between the two stations and thereby skew the substrates to a predetermined position in order to align the substrates with images on a belt of the copier/printer.

5. In a printing apparatus having an image transfer area and copy sheet registration means for driving copy sheets into the transfer area where images are transferred to the copy sheets, the improvement characterized by a copy sheet skew adjustment device for insuring alignment of images transferred to the copy sheets, comprising:

adjustable baffle means positioned to contact the image side of copy sheets between the transfer area nd the registration means, and means for adjusting said adjustable baffle means in a predetermined direction in order to shorten a portion of the distance the copy sheets have to travel between the transfer area and the registration rolls and thereby adjust skew of the copy sheets.

6. The printing apparatus of claim 5, wherein said adjustable baffle is hinged on one end thereof.

7. The printing apparatus of claim 5, wherein said means for adjusting said adjustable baffle means includes a screw and nut mechanism positioned at one end of said baffle means and a multi-positionable hinge means at the other end of said baffle means.

8. A device for correcting image to copy skew of substrates in a copy sheet path traveling between two stations, comprising:

adjustable baffle means in which the substrates travel en route from one station to the other; and adjustment means for moving said adjustable baffle into and out of the path of the substrates in order to shorten the distance the substrates have to travel between the two stations and thereby skew the substrates to a predetermined position in order to align the substrates with images to be transferred to the copy sheets subsequently.

9. In a printing apparatus that includes a belt with a photoconductive surface with a transfer area thereon, and copy sheet registration means for driving copy sheets into the transfer area where images are transferred to the copy sheets, the improvement characterized by a copy sheet skew adjustment device for insuring alignment of images transferred to the copy sheets, comprising:

adjustable baffle means positioned to contact the image side of copy sheets between the transfer area and the registration means; and means for adjusting said adjustable baffle means in a predetermined direction and move said adjustable baffle means toward or away form said belt in order to change the point at which each copy sheet leading edge contacts said belt, and thereby adjust skew of the copy sheets.

10. The printing apparatus of claim 9, wherein said means for adjusting said adjustable baffle means includes a screw and nut mechanism positioned at one end of said baffle means and a multi-positionable hinge means at the other end of said baffle means.

11. The device of claim 8, wherein said adjustable baffle means include a transport baffle that has an inboard and outboard end with respect to the copy sheet path, and wherein moving of said adjustable baffle means by said adjustment means causes only said outboard end of said transport baffle to protrude into the copy sheet path.

12. A method for aligning copy sheets with images on a photoreceptor of a printer apparatus that includes a paper path, comprising the steps of:

providing an adjustment baffle along the paper path;

running copy sheets through the paper path to receive page image information thereon;

observing said page image information for misalignment, and if there is any misalignment of the images on the copy sheets;

adjusting said alignment baffle to either protrude predetermined distance into or out of the copy sheet path to thereby skew the sheets and correct for image to copy sheet misalignment.

13. The method of claim 12, including the step of providing said alignment baffle on the image side of the copy sheets.

* * * * *